US012037034B2

(12) United States Patent
Indre et al.

(10) Patent No.: US 12,037,034 B2
(45) Date of Patent: Jul. 16, 2024

(54) METHOD AND SYSTEM FOR MANAGING GUIDED VEHICLE TRAFFIC WITHIN A RAILWAY NETWORK

(71) Applicant: Siemens Mobility SAS, Chatillon (FR)

(72) Inventors: Marius Traian Indre, Verrieres-le-Buisson (FR); Thierry Bouchet, Antony (FR)

(73) Assignee: Siemens Mobility SAS, Chatillon (FR)

( * ) Notice: Subject to any disclaimer, the term of this patent is extended or adjusted under 35 U.S.C. 154(b) by 208 days.

(21) Appl. No.: 17/691,320

(22) Filed: Mar. 10, 2022

(65) Prior Publication Data

US 2022/0289259 A1 Sep. 15, 2022

(30) Foreign Application Priority Data

Mar. 10, 2021 (EP) ..... 21290016

(51) Int. Cl.
*B61L 27/30* (2022.01)
*B61L 21/04* (2006.01)
(Continued)

(52) U.S. Cl.
CPC ..... *B61L 27/30* (2022.01); *B61L 21/04* (2013.01); *B61L 27/04* (2013.01); *B61L 27/12* (2022.01);
(Continued)

(58) Field of Classification Search
CPC ..... B61L 21/04; B61L 27/04; B61L 27/12; B61L 27/14; B61L 27/16; B61L 27/30; B61L 27/40
See application file for complete search history.

(56) References Cited

U.S. PATENT DOCUMENTS 7,512,481 B2 * 3/2009 Julich ..... G06Q 10/08 701/19
9,744,981 B2 8/2017 Niinomi et al.

FOREIGN PATENT DOCUMENTS

CN 103264714 B 8/2015

OTHER PUBLICATIONS

Pochet, Juliette et al: "Supervision and rescheduling of a mixed CBTC traffic on a suburban railway line"; 2016 IEEE International Conference on Intelligent Rail Transportation (ICIRT), IEEE; Aug. 23, 2016 (Aug. 23, 2016), pp. 32-38; XP032978346.

* cited by examiner

*Primary Examiner* — Hung Q Nguyen
*Assistant Examiner* — Mark L. Greene
(74) *Attorney, Agent, or Firm* — Laurence A. Greenberg; Werner H. Stemer; Ralph E. Locher

(57) ABSTRACT

A method and system for managing guided vehicle traffic over a railway network include a first ATS system regulating guided vehicle traffic over a first regulation domain and a second ATS system regulating guided vehicle traffic over a second regulation domain. The first and second regulation domains have a common boundary. The first ATS system sends, to the second ATS system, configuration and circulation data for a part of the first regulation domain, for regulating guided vehicle traffic on the part according to a set of regulation data from the second ATS system. The second ATS system determines, from received configuration and circulation data, regulation data for an extended regulation domain including the second regulation domain and the part and for sending to the first ATS system the set of regulation data regulating the guided vehicle traffic on the part of the regulation domain of the first ATS system.

19 Claims, 3 Drawing Sheets

(51) Int. Cl.

| | |
|---|---|
| ***B61L 27/04*** | (2006.01) |
| ***B61L 27/12*** | (2022.01) |
| ***B61L 27/14*** | (2022.01) |
| ***B61L 27/16*** | (2022.01) |
| ***B61L 27/40*** | (2022.01) |

(52) U.S. Cl.
CPC ..... *B61L 27/14* (2022.01); *B61L 27/16* (2022.01); *B61L 27/40* (2022.01)

METHOD AND SYSTEM FOR MANAGING GUIDED VEHICLE TRAFFIC WITHIN A RAILWAY NETWORK

CROSS-REFERENCE TO RELATED APPLICATION

This application claims the priority, under 35 U.S.C. § 119, of European Patent Application EP 21 290 016.1, filed Mar. 10, 2021; the prior application is herewith incorporated by reference in its entirety.

FIELD AND BACKGROUND OF THE INVENTION

The present invention relates to a system and a method for managing guided vehicle traffic within a railway network, and more particularly at a junction point.

The present invention basically relates to the field of guided vehicles, wherein the expression "guided vehicle" refers to public transport systems such as subways, trains or train subunits, etc., as well as load transporting systems such as, for example, freight trains, for which safety is a very important factor and which are guided along a route or railway by at least one rail, in particular by two rails. More specifically, the present invention concerns safety aspects with respect to a railway network including such guided vehicles and focuses on the traffic of guided vehicles over the railway network.

Usually, the railway network is divided into different geographical areas, called regulation domains, each managed by an Automatic Train Supervision (ATS) system, the task of which is to manage the guided vehicle traffic on its assigned regulation domain according to specific regulation criteria or rules.

A typical guided vehicle management process follows the following steps:

Step 1: before any operation of a guided vehicle on an ATS system regulation domain, the ATS system managing the regulation domain receives a nominal timetable, i.e. a theoretical timetable, defining or including, for each guided vehicle having to move within its regulation domain and for a predefined time period (typically 1 day), a nominal schedule corresponding to a nominal operation (the nominal schedule might also be called a nominal "circulation": it defines the different positions of the guided vehicle within the regulation domain as a function of the time) of the considered guided vehicle within the regulation domain and within the predefined time period, the nominal schedule defining typically an objective arrival time and an objective departure time for successive positions, e.g. stations, within the regulation domain, the successive positions defining a planned route for the guided vehicle.

Step 2: during the operation of guided vehicles on its regulation domain, the ATS system continually tracks and monitors in real time guided vehicle effective operations on its regulation domain and builds a reference timetable, i.e. a real timetable, based on the effective operations. The reference timetable represents or shows a reference schedule. The reference schedule includes a real-time schedule for each guided vehicle having moved or moving on the regulation domain of the ATS system, as well as an estimated future schedule for guided vehicles moving or going to move on the regulation domain. The real-time schedule includes typically an effective arrival time and an effective departure time for successive positions already reached by a considered guided vehicle. The estimated future schedule includes an estimated future arrival time and an estimated future departure time for successive future positions of a considered guided vehicle. In particular, the ATS system is configured for determining an estimated future schedule that takes into account an effective delay in the real-time schedule with respect to the nominal schedule. For this purpose, it is preferentially configured for automatically adding, to the objective arrival time and/or objective departure time and for all guided vehicles moving or having to move on its regulation domain within a predefined timeframe (typically 60-90 minutes), a time value determined as a function of the effective delay. For all other guided vehicles which are moving or going to move within its regulation domain but outside of the timeframe, then the estimated future arrival time and/or the estimated future departure time are taken by the ATS system as equal to the objective arrival and departure time of the nominal timetable. The real-time schedule of a guided vehicle is thus based on the real operation of the guided vehicle and may differ from the nominal schedule, while the estimated future schedule is based on estimated guided vehicle operations in a near future.

For instance, and as explained in the next steps, if a tracked guided vehicle is delayed for an effective delay in respect to its nominal schedule, then its reference schedule in the reference timetable shall be adapted. In particular, the ATS system may calculate from the effective guided vehicle operations and the nominal timetable, the estimated future arrival time and departure time for a next position of a considered guided vehicle. The estimated future arrival and departure times might be shifted towards the future with the time value typically equal to the effective delay. This impacts also part or all the following guided vehicles within the considered timeframe: their nominal schedule might have also to be shifted if the effective delay of the tracked guided vehicle leads to breaking some specific regulation criteria like temporal rules of minimal headway between consecutive guided vehicles. Therefore, within its regulation domain, the ATS is configured for rescheduling guided vehicles in real time according to information provided by traffic monitoring devices equipping its regulation domain if a response to an event, e.g. delay, requires such rescheduling.

Step 3: during the operation of guided vehicles on its regulation domain, the ATS system continually compares the reference timetable to the nominal timetable in order to detect effective delays for a guided vehicle moving within its regulation domain.

Step 4: during the operation of guided vehicles on its regulation domain, the ATS system uses a set of algorithms configured for outputting an optimized timetable, the latter including typically the estimated future arrival and departure times for the guided vehicles, modifying thus the nominal timetable while satisfying specific regulation criteria. The ATS system uses the optimized timetable for creating or updating its reference timetable. Typically, before operation of any guided vehicle, e.g. at the beginning of the day, the reference timetable and the nominal timetable are identical. Then, as the day progresses, the reference timetable will diverge from the nominal timetable in real-time due to detected effective delays and their impact on future guided vehicle schedules considered within the above-mentioned timeframe. The ATS system uses the algorithm with, as inputs, the nominal timetable and the most recently determined reference timetable, for periodically (e.g. every 3 seconds) outputting the optimized timetable. The optimization is preferentially always done within the timeframe. The optimized timetable is then used to modify/update the most recently determined reference timetable before launching another optimization cycle. The modified/updated reference timetable is finally used by the ATS system to command interlocking and guided vehicle motion on its regulation domain.

The regulation criteria used for determining an optimized timetable are for instance:

a. Minimize delays between the nominal timetable and the reference timetable for all guided vehicle schedules;
b. Minimize headway difference between the nominal timetable and the reference timetable for all pairs of schedules of consecutive guided vehicle travelling in the same direction on the same route;
c. Minimize energy consumption of all guided vehicles having a schedule which is defined by the optimized timetable.

The algorithms might be configured for:

a. changing run times of guided vehicles, i.e. the time required for travelling from a first position to a second position;
b. changing dwell times at stations respecting a predefined minimum dwell time for each station;
c. changing guided vehicle routes without skipping guided vehicle station stops required by the nominal schedule of the guided vehicle.

Step 5: during operation of guided vehicles on its regulation domain, the ATS system provides a guided vehicle control system (e.g. a CBTC system), if any available, with a changed dwell and/or run time.

Step 6: during the operation of guided vehicles on its regulation domain, the ATS system commands interlocking mechanisms to set routes according to the reference timetable.

One problem related to ATS systems is the management of guided vehicles at junction points. Two types of junction points might be defined:

a convergent junction point that is defined as a point where two lines (with simple or double tracks), called branches, meet into one single line (with simple or double tracks), called mainline;

a divergent junction point that is defined as a point where a single line (with simple or double tracks), i.e. the mainline, splits in two lines (with simple or double tracks), i.e. the branches.

An ATS system in charge of traffic regulation at a convergent junction point will be called hereafter "convergent junction ATS system". An ATS system in charge of traffic regulation at a divergent junction point will be called hereafter "divergent junction ATS system". Unless otherwise specified, the wording "junction ATS system" will refer to an ATS system including a junction point within its regulation domain, wherein the junction point might be a convergent or divergent junction point. The junction ATS system wording will thus be used for describing features common to both a convergent junction ATS system and a divergent junction ATS system.

Problems arise then when two distinct ATS systems try to handle the regulation of guided vehicle traffic at a convergent junction or at a divergent junction, as schematically illustrated by FIG. 5. For instance, a first upstream ATS system—hereafter ATS_1—regulates traffic for a first upstream branch 11 and a second upstream ATS system—hereafter ATS_2—regulates traffic for a second upstream branch 21, wherein the regulation domain of the ATS_1 includes an upstream station 10 on the first upstream branch 11 and the regulation domain of the ATS_2 includes an upstream station 20 on the second upstream branch 21. The first upstream branch 11 and the second upstream branch 21 merges together into a main line ML at a convergent junction point CP. The mainline ML may include a convergent junction station 30 that is handled by a convergent junction ATS system—hereafter ATS_3—that interfaces the interlocking mechanisms for setting routes for guided vehicles crossing the convergent junction point CP. The upstream stations 10, 20 are each the last station on their respective branch 11, 21, that is upstream the convergent junction station 30 if any, or the convergent junction point CP. The mainline ML is then split into a first downstream branch 41 and a second downstream branch 42 at a divergent junction point DP. A divergent junction ATS system 4—hereafter ATS_4—handles the divergent junction point DP as well as a divergent junction station 40 if any. The ATS_4 interfaces with the interlocking mechanisms setting the route for guided vehicles crossing the divergent junction point DP and handles the divergent junction station 40 if any.

A first problem P1 is related to the handling of traffic regulation between ATS_1, ATS_2 and ATS_3. A second problem P2 is related to the handling of traffic regulation between the ATS_3 and ATS_4. At the moment, the management of a single convergent junction or of a track section containing a convergent junction followed by a divergent junction shared between multiple ATS systems is handled by operators of the different systems implicated through radio/telephone communication. Any issues leading to a change of the timetable in respect to the order in which trains should cross the convergent junction or divergent junction must be handled manually by operators of the different ATS systems. There is thus no simple and efficient solution capable of automatically handling guided vehicle traffic regulation for a convergent junction point followed by a divergent junction point when multiple ATS systems are involved in the traffic regulation.

SUMMARY OF THE INVENTION

It is accordingly an object of the invention to provide a method and a system for managing guided vehicle traffic within a railway network, which overcome the hereinaforementioned disadvantages of the heretofore-known methods and systems of this general type and which improve the management of guided vehicle traffic at a junction point involving traffic regulation handled by multiple ATS systems.

In order to achieve this object, the present invention proposes notably a system and a method for managing traffic of guided vehicles within a railway network as recited in the independent claims. Other advantages of the invention are presented in dependent claims.

For an ATS system to ensure smooth guided vehicle traffic regulation at a convergent junction point it should ideally contain in its regulation domain the following railway network elements:

The first station upstream of the convergent junction point on each of the converging branches of the convergent junction point, wherein upstream is defined with respect to a flow of guided vehicles moving on one of the converging branches towards the convergent junction, the stream going thus from each branch towards and in direction of the convergent junction;

The convergent junction station (if existing);

The convergent junction point.

Similarly, for an ATS system to ensure smooth guided vehicle traffic regulation on a track section including a convergent junction point followed by a divergent junction point it should ideally contain in its regulation domain the following railway network elements:

The convergent junction station (if existing);

The convergent junction point;

The divergent junction point;

The divergent junction station or the first station downstream of the divergent junction point on each of the diverging branches, wherein downstream is defined with respect to a flow of guided vehicles moving from the convergent junction towards the divergent junction, the stream going thus from the convergent junction point towards and in direction of the divergent junction.

With the foregoing and other objects in view there is provided, in accordance with the invention, a system for managing traffic of guided vehicles within a railway network, the system comprising:

a first ATS system configured for regulating the traffic of guided vehicles over a first regulation domain;

a second ATS system configured for regulating the traffic of guided vehicles over a second regulation domain different from the first regulation domain, wherein the first and the second regulation domains have a common boundary or border and wherein at least one track connects a first position located within the first regulation domain to a second position located within the second regulation domain, the first and second positions each being for instance a station position in the respective regulation domains, or simply a position wherein two tracks connect with each other in order to form a single track;

the first ATS system is configured for sending, to the second ATS system, configuration and circulation data for a part of the first regulation domain, the part extending preferentially from the common boundary to the first position, the first position being preferentially included in the extension, e.g. extending from the common boundary to the first station that a guided vehicle would cross after crossing the common boundary when moving on the track in the first regulation domain, the first station being preferentially included in the part, the first ATS system being further configured for regulating the traffic of guided vehicles on the part according to a set of regulation data received from the second ATS system. Thus, according to the present invention, the first position might be the position of the first station including preferentially at least two tracks connecting together in a single track connected to the second position;

the second ATS system is configured for determining regulation data for an extended regulation domain, wherein the extended regulation domain includes the second regulation domain and the part, wherein the regulation data are determined by the second ATS system based at least on the received configuration and circulation data, and optionally and preferentially, on its reference timetable, its nominal timetable, its own configuration and circulation data, and its traffic regulation criteria, the second ATS system being further configured for sending to the first ATS system the set of regulation data configured for regulating the traffic of guided vehicles on the part of the regulation domain of the first ATS system.

With the objects of the invention in view, there is also provided a method for managing traffic of guided vehicles over a railway network, the method comprising:

sending, to a second ATS system, configuration and circulation data for a part of a first regulation domain, wherein a first ATS system is configured for regulating the traffic of guided vehicles over the first regulation domain, wherein the second ATS system is configured for regulating the traffic of guided vehicles over a second regulation domain, wherein the first and second regulation domains have a common boundary, wherein at least one track connects a first position located within the first regulation domain to a second position located within the second regulation domain, and wherein the part extends preferentially from the common boundary to the first position;

receiving, by the second ATS system, the configuration and circulation data;

determining, by the second ATS system, regulation data for an extended regulation domain, wherein the regulation data are determined from the received configuration and circulation data, and optionally and additionally, from a reference timetable of the second ATS system, a nominal timetable of the second ATS system, its own configuration and circulation data, and its traffic regulation criteria, wherein the extended regulation domain includes the second regulation domain and the part;

sending, by the second ATS system and to the first ATS system, the set of regulation data configured for regulating the traffic of guided vehicles on the part of the regulation domain of the first ATS system;

regulating, by the first ATS system, the traffic of guided vehicles on the part according to the set of regulation data received from the second ATS system.

The present invention thus proposes that the second ATS system determines regulation data for an area, i.e. the part, which does not belong to the regulation domain of the second ATS, but which belongs to another ATS system that is the first ATS system. Indeed, the set of regulation data sent by the second ATS system to the first ATS system will oblige the latter to apply the regulation data included within the set, even if they contradict the traffic regulation criteria of the first ATS system. The latter, on the basis of the received set of regulation data, configuration and circulation data for the first regulation domain, and its own traffic regulation criteria, will determine regulation data that satisfy a maximum number of its traffic regulation criteria, while keeping the regulation data received within the set as "fixed" or "imposed" regulation data. For this purpose and preferentially, the first ATS system includes an algorithm for regulating and optimizing the traffic flow on its regulation domain, wherein the received regulation data (i.e. that are included within the set) are used as fixed parameters (i.e. as constraints) by the algorithm, and the latter outputs an optimized timetable that is based on the received regulation data and that maximizes the number of its traffic regulation criteria that are satisfied. Together with the received regulation data, other inputs might be used by the algorithm for outputting the optimized timetable, like the reference timetable, the nominal timetable, its traffic regulation criteria, and its own current configuration and circulation data for the first regulation domain.

In order to enable the extension of the regulation domain of the second ATS system to the part, additional data have to be exchanged between the first and second ATS system compared to prior art ATS systems. For enabling the communication between the first and second ATS systems of the additional data (which are actually the configuration and circulation data and then the set of regulation data), the present invention proposes to use a functional interface configured for enabling the transmission of the configuration and circulation data as well as of the set of regulation data between the first and second ATS systems.

According to the present invention, the configuration data include information regarding the leeway of guided vehicles that are moving and/or going to move on tracks within the part of the regulation domain and/or constraints for regulating the traffic of the guided vehicles on the part of the regulation domain. Typically, the configuration data includes, for each guided vehicle moving or having to move on the track, at least one, preferentially all, of the following data:

- at least one allowed travel time between two positions on the track within the part of the first regulation domain. Preferentially, the allowed travel time is defined as a minimum travel time (or otherwise the, as an allowed maximum mean speed) imposing that the travel time between the two positions be above the minimum travel time. Alternately, the configuration data may include several allowed travel times forming in such case a set of predefined travel times, for instance each predefined travel time in the set corresponding to a time of travel for a predefined run profile between the two positions. The two positions are preferentially the position of a platform of a station located on the track within the part of the first regulation domain and the position of the boundary;
- a minimum dwell time at the platform;
- a temporal constraint issued by an operator command and applying to the platform;
- a minimum headway value between the guided vehicle and another guided vehicle directly preceding or following the guided vehicle on the track within the part of the first regulation domain.

Typically, the circulation data includes, for each guided vehicle having to move on the track, at least one, preferentially all, of the following data:

- an arrival time at the platform and a departure time from the platform;
- a travel time between the platform and the boundary.

Typically, the set of regulation data includes, for each guided vehicle having to move on the track, at least one, preferentially all, of the following data:

- a time value defining the running of the guided vehicle between the platform and the boundary or a travel time from the platform to the boundary;
- a setpoint value for a dwell time at the platform;
- a time of arrival at the boundary.

According to the present invention, the set of regulation data do not include any data defining a position of an interlocking within the part of the first regulation domain.

The previously described extension of the regulation domain of an ATS system might be embodied for different configurations of the railway network. For instance, guided vehicles might move from the first position towards the second position (from upstream towards downstream), wherein a convergent junction point is installed at the second position and managed or controlled by the second ATS system and the part corresponds to an upstream extension of the second regulation domain of the second ATS system. In this case, the set of regulation data includes preferentially routing data, wherein the routing data includes at least the set point value for a run profile and the set point value for a dwell time. Alternately, guided vehicles are moving from the second position towards the first position (the second position being thus upstream and the first position downstream), and the railway network including at the first position a divergent junction point managed or controlled by the first ATS system, and the part corresponds to a downstream extension of the second regulation domain of the second ATS system. In this case, the set of regulation data includes preferentially a list that includes at least the time of arrival at the boundary for each guided vehicle moving on the track. These two cases will be described in more details afterwards in connection with the figures.

According to another configuration, the railway network includes at least three regulation domains, namely the first regulation domain managed by the first ATS system, the second regulation domain managed by the second ATS system, and a third regulation domain managed by a third ATS system, wherein the third regulation domain has a common boundary with the second regulation domain—let's call this common boundary the additional boundary-, and includes at least one position, called third position, located within the third regulation domain and that is connected by a track to this second position. In such a case, in addition to the extension of the regulation domain of the second ATS system to the part of the regulation domain of the first ATS system, the system according to the invention is further configured for extending the second regulation domain to an additional part, wherein the additional part extends preferentially from the additional boundary to the third position, the latter being preferentially included in the extension, e.g. from the additional boundary to the first station that a guided vehicle would cross after crossing the additional boundary when moving on the track in the third regulation domain.

In such a case, the third ATS system is configured for sending, to the second ATS system, configuration and circulation data for the additional part, and for regulating the traffic of guided vehicles on the additional part according to a set of regulation data received from the second ATS system. As previously described, the second ATS system already receives the configuration and circulation data from the first ATS system. In the present case, it will additionally receive the configuration and circulation data from the third ATS system. It will then determine from all configuration and circulation data that have been received from all directly neighboring ATS systems (i.e. notably from those sent by the first ATS system and those sent by the third ATS system) regulation data for an extended regulation domain, wherein the extended regulation domain includes this time the second regulation domain, the part, and additionally the additional part. As usual, the regulation data are determined by the second ATS system based at least on all received configuration and circulation data, and optionally its reference timetable, its nominal timetable, the configuration and circulation data, and its traffic regulation criteria. The second ATS system is then configured for sending to each of its directly neighboring ATS systems from which it received configuration and circulation data, notably in the present case to the first ATS system and to the third ATS system, their respective set of regulation data configured for regulating the traffic of guided vehicles on the area of their respective regulation domain for which the regulation data have been determined, i.e. notably a set of regulation data sent to the first ATS system for regulating the traffic on the part of the first regulation domain and a set of regulation data sent to the third ATS system for regulating the traffic on the additional part of the third regulation domain.

For instance, for this case of the second ATS system having the first and third ATS systems as neighbors, the second position may include a convergent junction point managed by the second ATS system, the first position a station managed by the first ATS system, wherein guided vehicles are moving from the station towards the convergent junction point, the track being thus an upstream branch connected to the convergent junction point, and at the third position is installed a divergent junction point managed by the third ATS system, wherein guided vehicles are moving from the second position towards the third position. In such a case, the set of regulation data sent to the first ATS system includes the routing data as previously explained and the set of regulation data sent to the third ATS system includes a list defining at least the time of arrival at the additional boundary for each guided vehicle moving on the track from the second position towards the third position.

Of course, other railway network configurations might be envisaged by the skilled person, wherein the present solution for managing the traffic of guided vehicles between two directly adjacent regulation domains managed each by an ATS system might be implemented. In particular, in FIG. 3-5, the first ATS system previously described corresponds to the ATS_1, the second ATS system corresponds to ATS_3, and the third ATS system corresponds to the ATS_4, the ATS_2 representing an additional ATS system the regulation domain of which includes a branch (track) connected to the second position, which is in particular a convergent junction point according to FIG. 3-5.

Other features which are considered as characteristic for the invention are set forth in the appended claims.

Although the invention is illustrated and described herein as embodied in a method and a system for managing guided vehicle traffic within a railway network, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
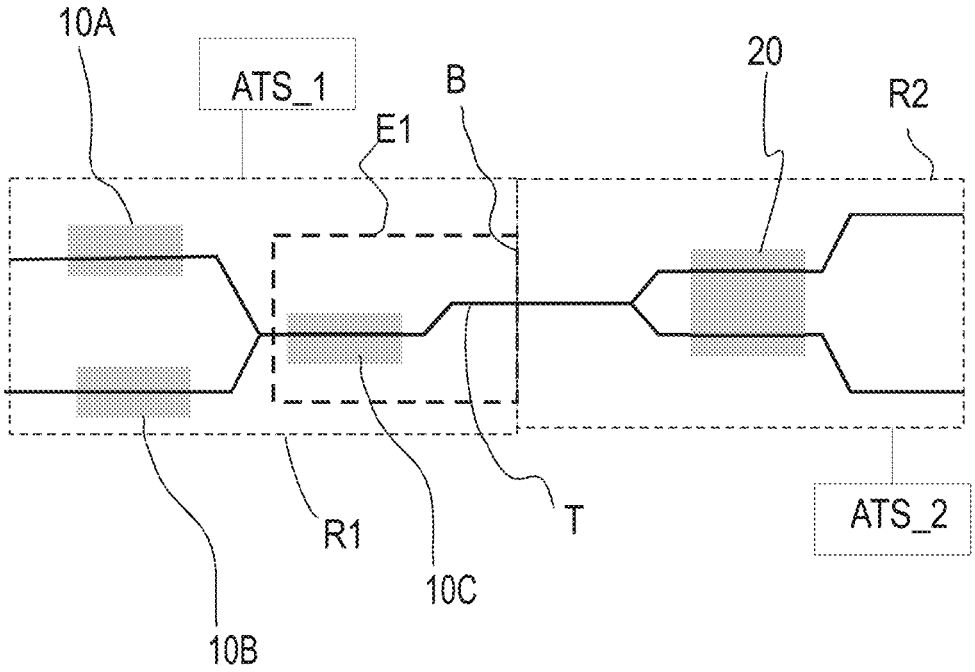
FIG. 1 is a schematic representation of a system according to the invention.

Referring now to the figures of the drawings in detail and first, particularly, to FIG. 1 thereof, there is seen a portion of a railway network divided into geographical areas corresponding to regulation domains and in which the guided vehicle traffic or flow on each regulation domain is managed by an ATS system. Preferentially, the regulation domain of at least one ATS system according to the invention includes at least two tracks, wherein the tracks connect together at a downstream and/or upstream junction point.

An ATS system according to the invention includes a processor, a memory, and communication devices. The memory, or an external database may include a set of traffic regulation criteria, a nominal timetable, a reference timetable based on the nominal timetable, and one or several algorithms based on the traffic regulation criteria. The ATS system is configured for applying the one or several algorithms to acquired or received traffic data (typically circulation and configuration data) for continuously or periodically updating its reference timetable and determining regulation data that are then applied at least within its regulation domain for controlling the guided vehicle traffic at least within the regulation domain. As further explained below in preferred embodiments, the present invention proposes indeed that at least one ATS system, among ATS systems having respective regulation domains which share a common boundary, is configured for extending its regulation domain by acquiring or receiving traffic data for a part of the regulation domain of another ATS system among the ATS systems having regulation domains which share the common boundary, determining regulation data for the part, sending the regulation data to the another ATS system, the latter being configured for applying the received regulation data when regulating guided vehicle traffic within its regulation domain. The received regulation data have thus to be applied by the another ATS system even if it contradicts its own traffic regulation criteria. The another ATS system is preferentially configured for optimizing the guided vehicle traffic or flow within its regulation domain as a function of the received regulation data, notably by updating its reference timetable, i.e. by determining the so-called optimized timetable. For such an update, the received regulation data are considered as fixed parameters when determining updated guided vehicle circulations or flows, and the ATS system automatically determines then the optimized timetable that will maximize the number of its traffic regulation criteria that are satisfied.

According to FIG. 1, a first ATS system ATS_1 regulates the traffic of guided vehicles over a first regulation domain R1. The latter may include one or several stations 10A, 10B, 10C. A second ATS system ATS_2 regulates the traffic of guided vehicle over a second regulation domain R2. The latter may include one or several platforms 20. The first and the second regulation domains R1, R2 have a common boundary B. At least one track T connects a first position located within the first regulation domain R1 to a second position located within the second regulation domain R2. According to the present invention, the first ATS system ATS_1 is configured for sending to the second ATS system ATS_2 configuration and circulation data for a part E1 of the first regulation domain R1. The part E1 extends in particular from the boundary B towards the first station that a guided vehicle crossing the boundary B for entering the first regulation domain would cross, preferentially including the first station. The second ATS system ATS_2 receives the configuration and circulation data and is configured for determining, from the latter, regulation data for an extended regulation domain including the second regulation domain R2 and the part E1. Then, the second ATS system ATS_2 is configured for sending back to the first ATS system ATS_1 a set of the determined regulation data, wherein the set includes regulation data configured for regulating the traffic of guided vehicles over the part E1. After reception of the set of regulation data, the first ATS system ATS 1 is configured for using the regulation data included within the set as imposed constraints for regulating the traffic of guided vehicles over its regulation domain R1, and therefore over the part E1. According to FIG. 1, guided vehicles may move from platform 10C towards platform 20, in such a case the second ATS system ATS_2 proceeds to an upstream extension of its regulation domain by including the part E1 in its regulation. If one considers then guided vehicles moving from platform 20 towards platform 10C, then the extension of the regulation domain of the second ATS system ATS_2 with the part E1 would correspond to a downstream extension of its regulation domain.

In the following, we will describe a preferred embodiment of the invention, wherein at least one ATS system includes a junction point within its regulation domain. Indeed, one advantage of the present invention is to enable an automatic traffic flow regulation at a junction point, so that guided vehicle traffic at the junction becomes more efficient and congestion problems are minimized. The junction point is typically a place where multiple railway lines interconnect, meet, and/or cross, requiring thus a physical connection between tracks of the multiple railway lines, and wherein the traffic regulation at the junction point involves at least two different ATS systems having regulation domains which share a common boundary or border, namely a junction ATS system in charge of the junction point, i.e. configured for handling traffic regulation at the junction point, and a directly neighboring ATS system in charge of regulating traffic for at least one of the multiple railway line which extends through the common boundary and connects with the other railway lines at the junction point. The solution proposed by the present invention is notably based on a functional interface between the at least two different ATS systems.

The junction point is considered as a point (or place) connecting at least three lines, wherein at least two lines—the so-called branches—are characterized by a flow of guided vehicles having the same first motion direction with respect to the junction point—i.e. the junction point is defined as a reference point for the motion direction, which devices that the guided vehicles are moving either towards or away from the junction point, or in other words that they are either entering or leaving the junction point or area—, and wherein a single line, the so-called main line, among the three lines is characterized by a flow of guided vehicle having a second motion direction with respect to the junction point, wherein the second motion direction is opposite to the first motion direction with respect to the junction point—that is if guided vehicles moving according to the first motion direction are moving towards the junction point, then guided vehicles moving according to the second motion direction are moving away from the junction point, and vice versa for guided vehicle moving away from the junction point according to the first motion direction. In other words, guided vehicles moving on the main line are leaving the junction if guided vehicle moving on the branches are entering the junction, and vice versa.

Figure 5:
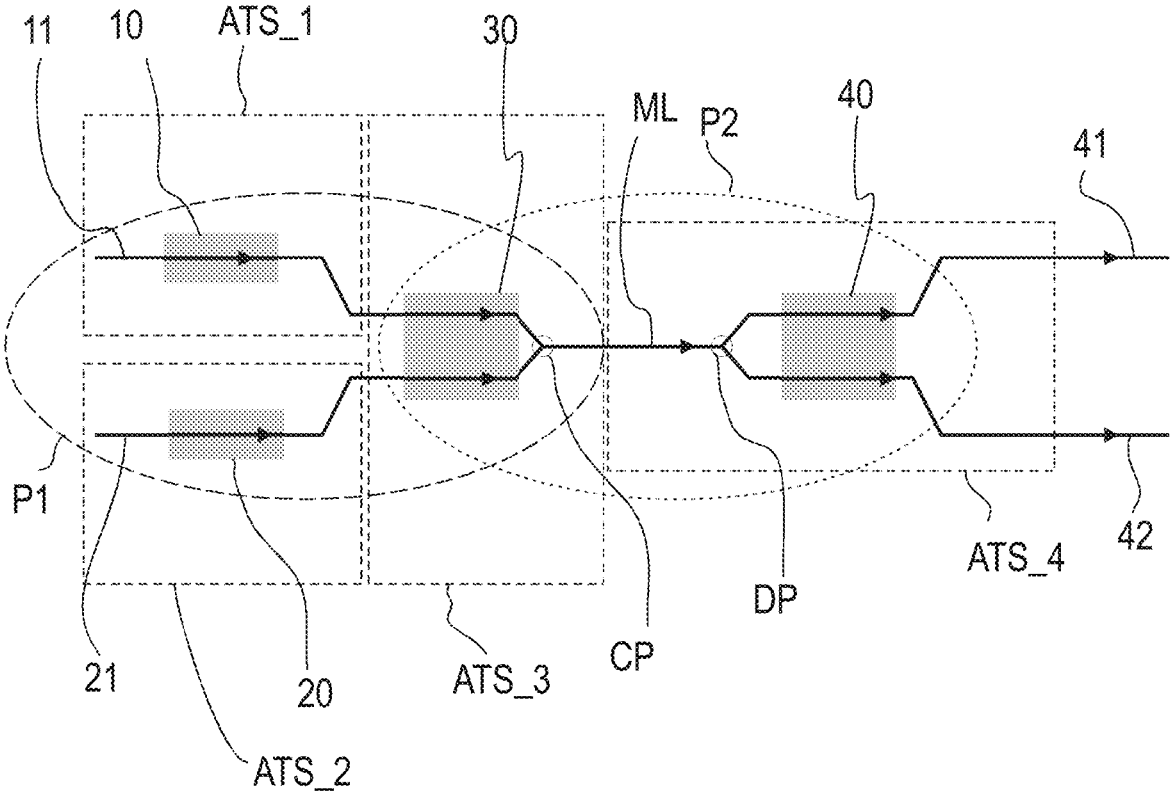
FIG. 5 is a schematic representation of a railway network divided into different regulation domains according to prior techniques.

In order to illustrate the present invention, we will describe hereafter a specific case wherein a convergent junction point is directly followed by a divergent junction point as shown in FIG. 5.

The system according to the present invention includes preferentially a functional interface configured for providing an extension of the regulation domain of the ATS_3, in particular an upstream and/or a downstream extension of its regulation domain. For the upstream extension of its regulation domain, the functional interface is an interface between the ATS_3 and each of the upstream ATS systems that regulates traffic on a branch 11, 21, upstream the convergent junction point CP, i.e. ATS_1 and ATS_2 according to FIG. 1. For the downstream extension of its regulation domain, the functional interface is an interface between the ATS_3 and the ATS_4. In the specific case of FIG. 5, the functional interface interfaces the ATS_3 with both each upstream ATS systems ATS_1 and ATS_2, and with the downstream ATS system ATS_4.

The upstream extension configuration of the functional interface is dedicated to the management of guided vehicle traffic flows at a single convergent junction point CP and is configured for ensuring that:

- a decision taken by the ATS_3 for managing the convergent junction is optimized with respect to its traffic regulation criteria, i.e. always satisfies the maximum number of traffic regulation criteria of the ATS_3;
- a decision taken by the ATS_3 for managing the convergent junction will not lead to a guided vehicle inadvertently stopping on tracks between one of the upstream stations 10, 20 on the first or second upstream branch 11, 21 and the convergent junction station 30.

The downstream extension configuration of the functional interface is dedicated to the management of guided vehicle traffic flows at a track section including a convergent junction point CP directly followed by a divergent junction point DP and is configured for ensuring that:

- a decision taken by the ATS_3 for managing the convergent junction is optimized with respect to its traffic regulation criteria, i.e. always satisfies the maximum number of traffic regulation criteria of the ATS_3;
- a decision taken by the ATS_3 for managing the convergent junction will not generate a traffic congestion on the mainline ML between the two convergent junction point CP and the divergent junction point DP.

Advantageously, the upstream extension configuration of the functional interface enables a smooth flow of guided vehicles on the mainline ML downstream of the convergent junction point CP with respect to the flow of guided vehicles on each upstream branch 11, 21.

According to the present invention, the upstream extension configuration of the functional interface enables the ATS_3 to extend its regulation domain to a portion of each of the upstream branches 11, 21. This makes the ATS_3 capable of regulating at the same time traffic flow for a small portion of each of the upstream branches 11, 21 upstream of the convergent junction point CP and for a portion of the mainline ML downstream of the convergent junction point CP. Thanks to the upstream extension configuration of the functional interface, the ATS_3 may communicate with each upstream ATS system and exchange traffic regulation information for handling guided vehicle traffic on each portion of the upstream branches 11,21 and on the portion of the mainline ML that belong to its regulation domain.

Figure 2:
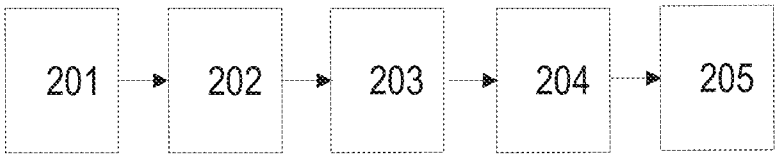
FIG. 2 is a flowchart of a preferred method according to the invention.

In particular, according to the present invention and as illustrated by FIG. 2, the ATS_3 is configured for:

- receiving 202 configuration and circulation data sent 201 by each upstream ATS system, namely ATS_1 and ATS_2, wherein the configuration and circulation data are configured for enabling the ATS_3 to extend its regulated domain, for each of the upstream branches 11, 21, up to the first station 10, 20 that is located upstream of the convergent junction point CP, the first station being preferentially included in the extension of its regulated domain, creating therefore an (upstream) extended regulation domain, the extended regulation domain including the "nominal or original" regulation domain of the ATS_3 plus the extension, i.e. the extended part up to the first upstream station of each upstream branches 11, 21;

determining 203, on the basis of its own traffic regulation criteria only, regulation data for regulating traffic flow within the extended regulation domain, disregarding therefore traffic regulation criteria of each of the upstream ATS systems ATS_1 and ATS_2, the latter having for instance traffic regulation criteria that might be different from the ATS_3 traffic regulation criteria;

sending 204 to each upstream ATS system, i.e. ATS_1 and ATS_2 according to FIG. 1, a set of the regulation data including routing data that impact the flow of guided vehicles or the regulation of the flow of guided vehicle within the extended part of its extended regulation domain, each upstream ATS system ATS_1, ATS_2 receiving thus a set of regulation data impacting the flow of guided vehicle within its own regulation domain only;

regulating 205 traffic flow within its nominal regulation domain according to the previously determined regulation data, wherein each upstream ATS system (ATS_1 and ATS_2) is configured for applying the routing data provided by the ATS_3 when regulating the flow of guided vehicles on its own regulation domain even if it contradicts with its own traffic regulation criteria, each upstream ATS, i.e. ATS_1 and ATS_2, regulating the guided vehicle traffic flow on its regulation domain as a best effort in respect to its traffic regulation criteria, i.e. by maximizing the number of traffic regulation criteria satisfied by its regulation of the guided vehicle traffic flow on its own regulation domain while applying the routing data provided by the ATS_3.

According to the present invention, the configuration and circulation data which enable the ATS_3 to extend its regulation domain up to, and optionally including, the first station 10, 20 upstream of the convergent junction point CP on each upstream branch 11, 21 depend on each particular ATS system impacted by the extension and how the particular ATS system has been deployed. Preferentially, the circulation data are sent by each upstream ATS system at a predetermined frequency. Preferentially, the configuration data are sent by each upstream ATS system on an event-driven basis.

According to the present invention, the configuration data sent by an upstream ATS system ATS_1, ATS_2 to the ATS_3 include at least the following data:

for each guided vehicle having a route which follows an upstream branch within a regulation domain of an upstream ATS system ATS_1, ATS_2 and is crossing the boundary between the regulation domain of the considered upstream ATS system ATS_1, ATS_2 and the regulation domain (i.e. nominal regulation domain) of the ATS_3:

one or several allowed travel times, and optionally, for each of the latter, an updated allowed travel time if a temporary speed restriction is applied to a portion of track within the extension. Preferentially, if such a temporary speed restriction is applied to the portion of track, then the upstream ATS system is configured for automatically updating the allowed travel time by automatically sending the updated allowed travel time to the ATS_3. In particular, the upstream ATS system might send a single allowed travel time, which is, in such a case, defined as a minimum travel time between a position within its regulation domain and the boundary. Alternately, the upstream ATS system may send a set of travel times, which are defined as the possible/allowed travel times between the position and the boundary;

for each upstream branch 11, 21 along which the guided vehicle might move or is planned to move (according to its defined route or schedule) for crossing the boundary, a minimum dwell time at a platform of the first upstream station 10, 20 of the considered upstream branch, wherein the platform is the first upstream station platform wherein the guided vehicle is going to pass or stop.

Preferentially, the upstream ATS system is configured for automatically sending updated configuration data if an operator command would apply a temporal constraint to the guided vehicle, the temporal constraint impacting a motion of the guided vehicle at a position falling within the extension defined within the upstream ATS system regulation domain. For instance, a temporal constraint issued by an operator command and applying to the platform of the first upstream station 10, 20 of the considered upstream branch 11, 21 and/or applying to an interstation, i.e. portion of track, going from the platform of the first upstream station 10, 20 of the considered upstream branch 11, 21 to the boundary between the regulation domains of the considered upstream ATS system and the ATS_3 may automatically trigger the determination of the updated allowed minimum travel time, and/or of an updated minimum dwell time at the platform, and/or of an updated run profile, that is or are then automatically sent to the ATS_3.

for each couple or pair of successive guided vehicles having a route which is crossing or going to cross the boundary between the regulation domain of the considered upstream ATS system ATS_1, ATS_2 and the regulation domain (i.e. nominal regulation domain) of the ATS_3:

a minimum headway value that has to be satisfied or respected on the interstation going from the platform of the first upstream station on the considered upstream branch until the boundary between the regulation domains of the considered upstream ATS system and the ATS_3.

According to the present invention, the circulation data sent by an upstream ATS system ATS_1, ATS_2 to the ATS_3 include at least the following data:

for each guided vehicle having a route which is crossing the boundary between the regulation domain of the considered upstream ATS system ATS_1, ATS_2 and the regulation domain (i.e. nominal regulation domain) of the ATS_3:

an arrival time and a departure time defined for the platform of the first upstream station of the upstream branch 11, 21 followed by the route, wherein the arrival time and departure time have been defined, determined or stored by the considered upstream ATS system ATS_1, ATS_2 and satisfy the traffic regulation criteria of the considered upstream ATS system;

a travel time from the platform of the first upstream station of the upstream branch 11, 21 followed by the route to the boundary between the regulation domain of the considered ATS system ATS_1, ATS_2 and the ATS_3, wherein the travel time has been defined, determined or stored by the considered upstream ATS system ATS_1, ATS_2 and satisfies the traffic regulation criteria of the considered upstream ATS system.

According to the present invention, the regulation data include routing data that are configured for impacting the guided vehicle traffic flow within the extended part of the extended regulation domain of the ATS_3, the extended part being a part of the regulation domain of each upstream ATS system ATS_1, ATS_2 which includes at least one upstream branch that connects with the convergent junction point CP, the regulation data, and consequently routing data, depending on each particular ATS system impacted by the extension and how the particular ATS system has been deployed.

According to the present invention, the routing data sent by the ATS_3 to each upstream ATS system ATS_1, ATS_2 include at least the following data:

- for each guided vehicle having a route which follows an upstream branch within a regulation domain of an upstream ATS system ATS_1, ATS_2 and is crossing the boundary between the regulation domain of the considered upstream ATS system ATS_1, ATS_2 and the (nominal) regulation domain of the ATS_3:
- a time value for a run profile or a travel time to be set for the guided vehicle for travelling from the platform of the first upstream station 10, 20 on the considered upstream branch 11, 21 to the boundary between the regulation domains of the considered upstream ATS system and the ATS_3;
- a setpoint value for a dwell time at the platform of the first upstream station 10, 20 on the upstream branch 11, 21 of the considered upstream ATS system ATS_1, ATS_2.

Preferentially, the routing data that impact the guided vehicle motion in the extended part of the ATS_3 regulation domain are free of any setpoint value configured for defining a position of an interlocking mechanism located within the extended part. Indeed, according to the present invention, while the guided vehicle running conditions (e.g. its speed as a function of its position, a travel time between two locations of the railway network) and its dwell times might be impacted according to the previously described method, each ATS system (upstream, convergent or divergent ATS system) remains independent with respect to guided vehicle route settings (i.e. the setting of the route that will be effectively followed by the guided vehicle for reaching a specific location on the railway network) once the guided vehicle running conditions and dwell times are defined or established.

Figure 3:
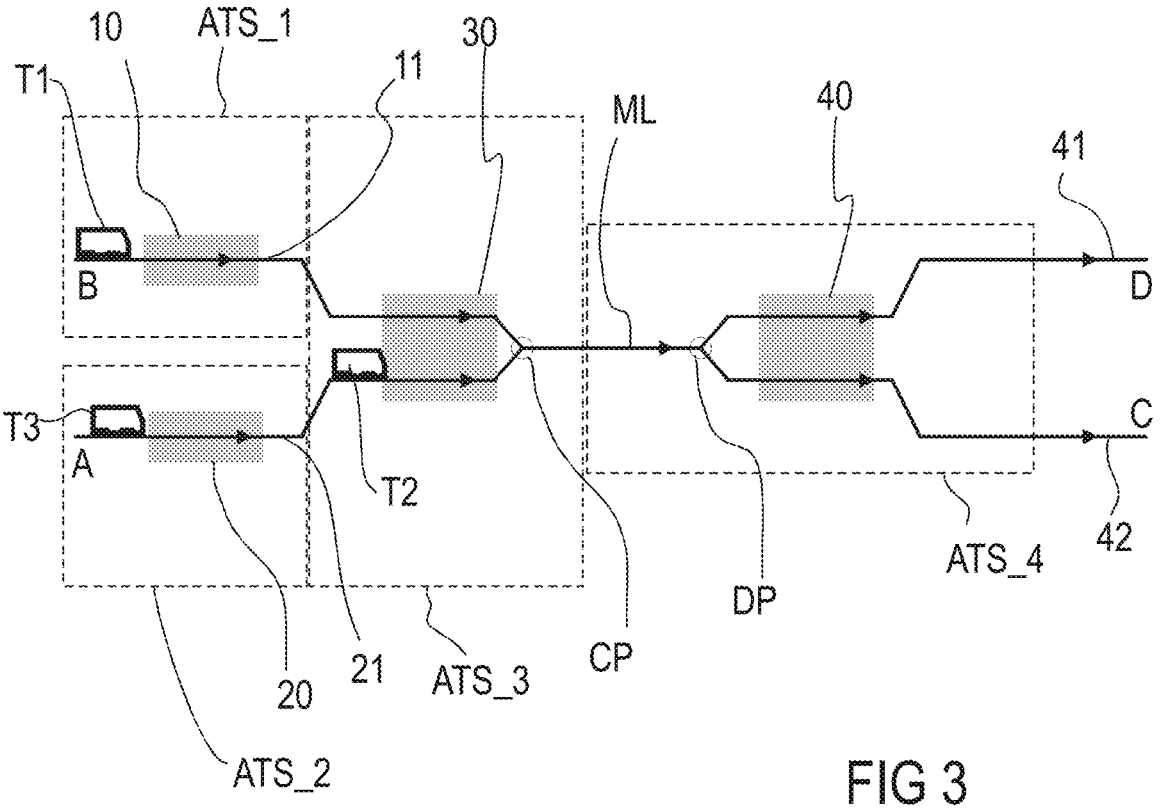
FIG. 3 is a schematic illustration of an upstream extension of a regulation domain of an ATS system.

An illustration of the upstream extension configuration of the functional interface might be provided by the following scenario, based on FIG. 3: A first train T1 that is the next train having a route which crosses the convergent junction point CP in a reference timetable of the ATS_3 is a train coming from the upstream branch 11—let's call it branch B—the traffic of which is regulated, upstream, by the ATS_1. Due to traffic congestion on the railway network, the first train T1 is late and is currently arriving at the first upstream station 10 on branch B 11.

Trains on the upstream branch 21—let's call it branch A—regulated by the ATS_2 are on time and one train, called second train T2, is arriving at the convergent junction station 30 and another, called third train T3, is arriving at the first upstream station 20 on branch A 21.

In this scenario, the ATS_3, having received, according to the present invention, all the configuration and train circulation data from both upstream ATS systems ATS_1 and ATS_2, becomes able to take the following decisions, based on its own traffic regulation criteria:

1. Let the first train T1 on branch B pass first at the convergent junction point CP, as required for satisfying the traffic regulation criteria of the ATS_3. Then, after taking the decisions, the ATS_3 sends a set of regulation data including routing data for the first train T1, wherein the routing data are configured for shortening its dwell time and speeding up its travel time towards the boundary between the regulation domains of the ATS_1 and ATS_3.
2. Hold up the second train T2 on branch A 21 at the platform of the convergent junction station 30 until the first train T1 on branch B 11 passes the convergent junction station 30 and delay the third train T3 on branch A 21 by a time value that satisfies a minimum allowed headway with the second train T2. Then, after taking the decisions, the ATS_3 sends to the ATS_2 a set of regulation data including routing data for the third train T3, wherein the routing data are configured for adapting the dwell time and travel time of the third train T3 towards the boundary between the regulation domains of the ATS_2 and ATS_3 so as to respect the minimum headway with the second train.

After sending to the upstream ATS systems ATS_1 and ATS_2 their respective routing data, the ATS_1 will adapt the traffic flow of trains within its regulation domain so that the routing data it received are satisfied, and the same will apply to the ATS_2 which will adapt for instance all traffic flows upstream of the first upstream station 20 on branch A 21 taking into account the new regulation data for the third train T3. As a result, no train will inadvertently stop on the tracks between the first upstream train stations on each upstream branch 11, 21 and the convergent junction station 30.

According to the present invention, the downstream extension configuration of the functional interface is configured for enabling and securing a smooth flow of guided vehicles moving on the mainline ML downstream of the convergent junction point CP towards the divergent junction point DP by enabling a sending from the ATS_4 to the ATS_3 of detailed traffic information, i.e. guided vehicle flow information, for an area extending outside of the ATS_3 regulation domain, the area extending from the mainline ML, including preferentially at least a part of the latter, down to, and preferentially including, the divergent junction station 40, wherein the guided vehicle flow on this area is, according to prior techniques, only regulated by the ATS_4 that is a divergent junction ATS system having a common boundary with the ATS_3. The area is the extended part of the regulation domain of the ATS_3 for the downstream extension configuration of the functional interface, the extended part together with its regulation domain forming a (downstream) extended regulation domain. When the functional interface includes both the upstream and downstream extension configurations, then the regulation domain of the ATS_3 is extended upstream and downstream by respectively the upstream extended part and the downstream extended part, forming therefore an extended regulation domain including the "nominal" regulation domain of the ATS_3, the upstream extended part and the downstream extended part.

The downstream extension configuration of the functional interface enables notably the ATS_3 to extend its regulation domain to the downstream extended part which includes a portion of the main line ML, the divergent junction point DP, and preferentially also the divergent junction station 40. Thanks to the downstream extension configuration of the functional interface, the ATS_3 may communicate with the ATS_4 and exchange traffic regulation information for handling guided vehicle traffic on the downstream extended part of the railway network.

As usual, the ATS_3 is the system that determines and regulates the flow of guided vehicles, e.g. a circulation order of the guided vehicles, on the mainline ML. Thanks to the downstream extension configuration and compared to existing ATS systems, the ATS_3 is further configured for:

receiving 202 configuration and circulation data from the ATS_4, wherein the configuration and circulation data are configured for enabling the ATS_3 to extend its regulation domain down to, and preferentially including, the divergent junction station 40;

determining 203, on the basis of its own traffic regulation criteria only, regulation data for regulating traffic flow within the extended regulation domain, disregarding therefore traffic regulation criteria of the ATS_4 for the downstream extended part;

sending 204 to the ATS_4 a set of the regulation data including a list defining an order according to which guided vehicles have to pass the boundary between the regulation domains of the ATS_3 and the ATS_4, the order classifying for instance the guided vehicles as a function of the time at which they have to cross the boundary;

regulating 205 traffic flow within its nominal regulation domain according to the previously determined regulation data, wherein the ATS_4 is configured for using the list and applying the order to its timetable reference when regulating the flow of guided vehicles on its own regulation domain, the flow being regulated as a best effort in respect to its traffic regulation criteria, i.e. by maximizing the number of traffic regulation criteria satisfied by its regulation of the guided vehicle traffic flow on its own regulation domain while applying the list, and thus order, to its timetable reference.

According to the present invention, the configuration and circulation data which enables the ATS_3 to extend its regulation domain down to, and optionally including, the divergent junction station 40 depend on each particular ATS system impacted by the extension and how the particular ATS system has been deployed. Preferentially, the circulation data are sent by the ATS_4 at a predetermined frequency. Preferentially, the configuration data are sent by the ATS_4 on an event-driven basis, e.g. in case of a temporal constraint impacting the traffic on an extension.

According to the present invention, the configuration data sent by the ATS_4 to the ATS_3 include at least the following data:

for each guided vehicle the route of which is crossing the boundary between the regulation domain of the ATS_3 and the regulation domain of the ATS_4:

one or several allowed travel times, and optionally, for each of the latter, an updated allowed travel time if a temporary speed restriction is applied to a portion of track within the extension. Preferentially, if such a temporary speed restriction is applied to the portion of track, then the downstream ATS system is configured for automatically updating the allowed minimum travel time by automatically sending the updated allowed minimum travel time to the ATS_3. In particular, the downstream ATS system might send a single allowed travel time, which is, in such a case, defined as a minimum travel time, i.e. a minimum value for the travel time between a position within its regulation domain and the boundary. Alternately, the upstream ATS system may send a set of travel times, which are defined as the possible/allowed travel times between the position within the regulation domain of the downstream ATS system and the boundary;

a minimum dwell time at a platform of the divergent junction station 40.

Preferentially, the downstream ATS system ATS_4 is configured for automatically sending updated configuration data if an operator command would apply a temporal constraint to the guided vehicle, the temporal constraint impacting a motion of the guided vehicle at a position falling within the extension defined within the downstream ATS system regulation domain. For instance, a temporal constraint issued by operator command and applying to the platform of the divergent junction station 40 and/or applying to an interstation going from the boundary between the regulation domains of the ATS_3 and ATS_4 to the platform of the divergent junction station 40 may automatically trigger the determination of the updated allowed minimum travel time, and/or of an updated minimum dwell time at the platform, and/or of an updated run profile, that is or are then automatically sent to the ATS_3 by the ATS_4.

for each couple or pair of successive guided vehicles having a route which is going to cross the boundary between the regulation domains of the ATS_3 and ATS_4:

a minimum headway value that has to be satisfied or respected on the interstation going from the boundary between the regulation domain of ATS_3 and the regulation domain of the ATS_4 to the platform of the divergent junction station 40.

According to the present invention, the circulation data sent by the divergent junction ATS system ATS_4 to the ATS_3 include at least the following data:

for each guided vehicle having a route which is crossing the boundary between the regulation domain of the ATS_4 and the regulation domain of the ATS_3:

an arrival time at, and a departure time from, the platform of the divergent junction station 40, wherein the arrival and departure times have been defined, determined or stored by the ATS_4 and satisfy the traffic regulation criteria of the ATS_4;

a travel time from the boundary between the regulation domains of the ATS_3 and ATS_4 to the platforms of the divergent junction station 40, wherein the travel time has been defined, determined or stored by the ATS_4 and satisfies the traffic regulation criteria of the ATS_4.

According to the present invention, the regulation data may include the routing data and/or the list. The list is preferentially sent within the regulation data in the case of the downstream extension and the routing data are preferentially sent in the case of the upstream extension. The list includes the order according to which guided vehicles have to cross the boundary between the regulation domain of the ATS_4 and the regulation domain of the ATS_3, i.e. it defines which guided vehicle is the first to cross the boundary, then which one is in second position, which one in third position, etc., and according to which time.

Preferentially, the list sent by the ATS_3 to the ATS_4 includes:

for each guided vehicle crossing the boundary between the regulation domain of the ATS_3 and the regulation domain of the ATS_4:

a time of arrival at the boundary as determined, stored or defined by the ATS_3, wherein the time of arrival has been determined, e.g. by the ATS_3, by applying its own traffic regulation criteria.

Figure 4:
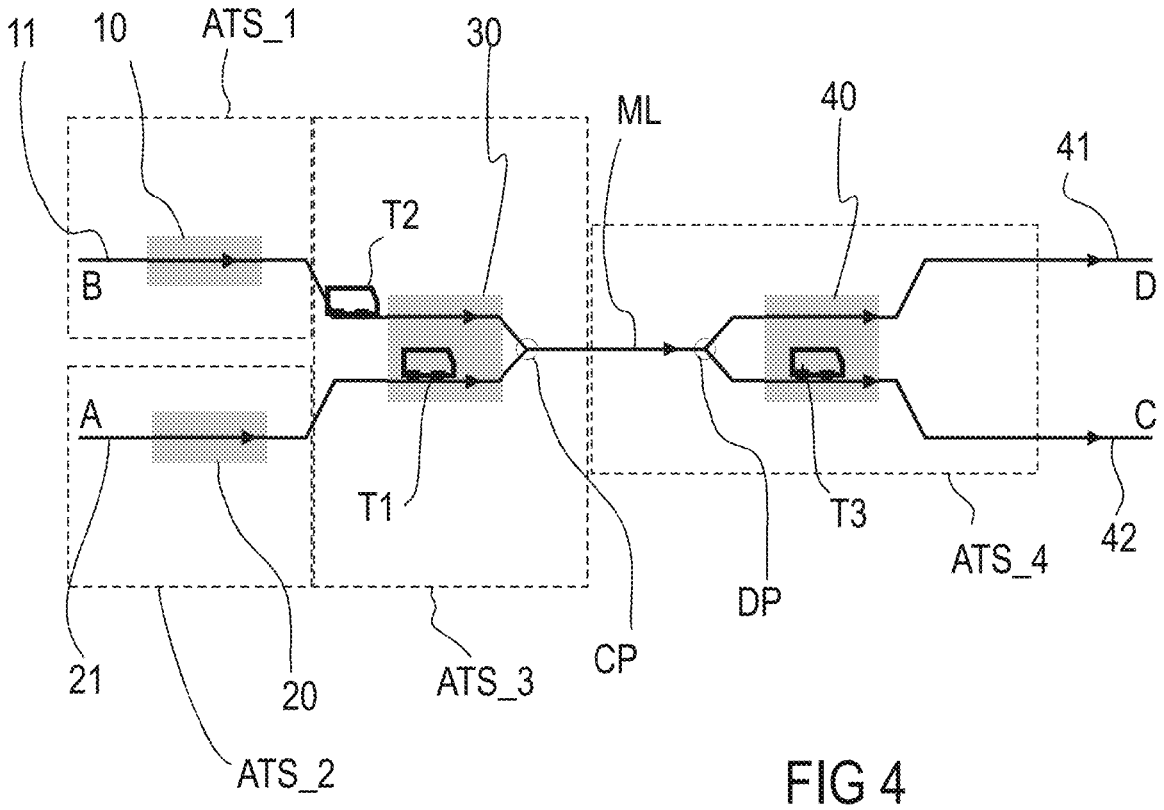
FIG. 4 is a schematic illustration of a downstream extension of a regulation domain of an ATS system.

An illustration of the downstream extension configuration of the functional interface might be provided by the following scenario, based on FIG. 4: A first train T1 that is the next train having a route which crosses the convergent junction point CP according to a reference timetable of the ATS_3 is a train coming from branch A 21, and having a route which follows then the downstream branch 42, called hereafter branch C. The first train T1 is currently at the platform of the convergent junction station 30. At the same time, a second train T2 coming from branch B 11 is arriving at the platform of the convergent junction station 30. The route of this second train follows then the downstream branch 41, called hereafter branch D. Unfortunately, due to traffic congestion, the previous train which came from branch A 21 and that crossed the convergent junction point CP, let's call it "third train" T3, is blocked on branch C 42 at the platform of the divergent junction station 40 downstream.

In this scenario, the ATS_3, having received, according to the present invention, all the configuration and train circulation data from the downstream ATS system ATS_4, becomes able to take the following decisions, based on its own traffic regulation criteria:

1. Let the second train T2 currently occupying branch B 11 pass first at the convergent junction point CP, because the branch D 41 is not congested downstream. Let also this second train T2 respect its schedule defined in the reference timetable of the ATS_3 without any further delays by not modifying the schedule defined in the reference timetable;
2. Hold up the first train T1 on branch A 21 at the platform of the convergent junction station 30 until it receives circulation data from the ATS_4 indicating that the third train T3 on branch C 42 at the divergent junction station 40 is leaving or will soon leave the platform, notably at a time allowing the first train T1 to depart from the convergent junction 30 and travel free of any disturbance until reaching the divergent junction station 40. Consequently, the ATS_3 automatically adapts the dwell time and the travel time towards the boundary between its regulation domain and the regulation domain of the ATS_4 so as to respect the minimum headway allowed for the successive first train T1 and third train T3.
3. Adapt all train circulation upstream of the convergent junction station 30 on branch A 21, either directly (for the part of the branch A 21 belonging to its regulation domain) and/or by using the previously described upstream extension configuration of the functional interface (for the part of branch A 21 belonging to another upstream ATS system, namely ATS_2) in order to exchange the routing data with another upstream ATS system on branch A 21, e.g. ATS_2.
4. Create the list wherein the order of the trains crossing the boundary between the ATS_3 regulation domain and the regulation domain of the downstream ATS system ATS_4 is updated and send the list to the ATS_4.

This process will be repeated for all trains having a route which goes from branch B 11 towards branch D 41 as long as the third train T3 on branch C 42 is blocked at the platform of the divergent junction station 40. As a result, no train on branch A 21 will inadvertently stop on the tracks of the mainline ML between the convergent junction station 30 and the divergent junction station 40. Furthermore, the traffic congestion problem for trains moving from branch A 21 to branch C 42 will never delay trains moving from branch B 11 towards branch D 41.

In conclusion, the present invention provides an automatic regulation of the flow of guided vehicles between consecutive ATS systems when an incident or event occurs and requires an update of guided vehicle circulations/schedules. This invention thus considerably reduces the workload of operators of ATS systems in stressing situations resulting from incidents or events impacting train traffic around junction points. Among the main advantages of the present invention, there are notably ensuring a smooth guided vehicle traffic on the mainline ML downstream of the junction point and automatically adjusting guided vehicle traffic on any of the branches upstream of the junction point.

The invention claimed is:

1. A system for managing traffic of guided vehicles within a railway network, the system comprising:

a first ATS system configured for regulating the traffic of the guided vehicles over a first regulation domain;

a second ATS system configured for regulating the traffic of the guided vehicles over a second regulation domain, the first and second regulation domains having a common boundary and at least one track connecting a first position located within the first regulation domain to a second position located within the second regulation domain;

said first ATS system configured for sending, to said second ATS system, configuration data and circulation data for a part of the first regulation domain, and for regulating the traffic of the guided vehicles on the part according to a set of regulation data received from said second ATS system; and said second ATS system configured for determining, at least from said configuration data and said circulation data, regulation data for an extended regulation domain including the second regulation domain and the part, and for sending to said first ATS system said set of said regulation data configured for regulating the traffic of the guided vehicles on the part of the first regulation domain of said first ATS system.

2. The system according to claim 1, wherein: the part extends from the common boundary to said first position.

3. The system according to claim 1, wherein said configuration data includes, for each guided vehicle having to move on the track, at least one data item selected from the group consisting of:

at least one allowed travel time between two positions on the track within the part of the first regulation domain; or a minimum dwell time at a platform of a station located on the track within the part of the first regulation domain; and a minimum headway value between a guided vehicle and another guided vehicle directly preceding or following the guided vehicle on the track within the part of the first regulation domain.

4. The system according to claim 1, wherein the circulation data includes, for each guided vehicle having to move on the track, at least one data item selected from the group consisting of:

an arrival time at a platform and a departure time from the platform; and a travel time between the platform and the boundary.

5. The system according to claim 1, wherein said set of said regulation data includes, for each guided vehicle having to move on the track, at least one data item selected from the group consisting of:

a time value for a run profile defining running of a guided vehicle between a platform and the boundary or a travel time from the platform to the boundary;

a setpoint value for a dwell time at the platform; and a time of arrival at the boundary.

6. The system according to claim 1, wherein said set of said regulation data is free of any data defining a position of an interlocking within the part of the first regulation domain.

7. The system according to claim 1, wherein a convergent junction point is installed at the second position and guided vehicles move from the first regulation domain towards the second regulation domain.

8. The system according to claim 1, wherein a divergent junction point is installed at the first position and guided vehicles move from the second regulation domain towards the first regulation domain.

9. The system according to claim 1, wherein said second ATS system is configured to determine the regulation data based on said configuration data and said circulation data sent by said first ATS system.

10. The system according to claim 9, wherein said second ATS system is configured to determine the regulation data based additionally on at least one item selected from the group consisting of: on a reference timetable of said second ATS system, a nominal timetable of said second ATS system, a current configuration data and circulation data of said second ATS system, and a traffic regulation criteria of said second ATS system.

11. A method for managing traffic of guided vehicles over a railway network, the method comprising:

providing a first ATS system for regulating the traffic of the guided vehicles over a first regulation domain;

providing a second ATS system for regulating the traffic of the guided vehicles over a second regulation domain;

sending configuration data and circulation data for a part of the first regulation domain to the second ATS system, providing the first and second regulation domains with a common boundary and at least one track connecting a first position located within the first regulation domain to a second position located within the second regulation domain;

receiving the configuration data and the circulation data at the second ATS system;

using the second ATS system to determine from the received configuration data and the received circulation data, regulation data for an extended regulation domain including the second regulation domain and the part;

using the second ATS system to send to the first ATS system a set of the regulation data configured for regulating the traffic of the guided vehicles on the part of the first regulation domain of the first ATS system; and using the first ATS system to regulate the traffic of the guided vehicles on the part according to the set of the regulation data sent by the second ATS system.

12. The method according to claim 11, wherein: the part extends from the common boundary to said first position.

13. The method according to claim 11, which further comprises providing the configuration data with data, for each guided vehicle having to move on the track, wherein the data provided in the configuration data includes at least one data item selected from the group consisting of:

at least one allowed travel time between two positions on the track within the part of the first regulation domain;

a minimum dwell time at a platform of a station located on the track within the part of the first regulation domain; and a minimum headway value between the guided vehicle and another guided vehicle directly preceding or following the guided vehicle on the track within the part of the first regulation domain.

14. The method according to claim 11, which further comprises providing the circulation data with data, for each guided vehicle having to move on the track, wherein the data provided in the circulation data includes at least one data item selected from the group consisting of:

1) an arrival time at a platform and a departure time from the platform; and 2) a travel time between the platform and the boundary.

15. The method according to claim 11, which further comprises providing the set of the regulation data with data, for each guided vehicle having to move on the track, wherein the data provided in the regulation data includes at least one data item selected from the group consisting of:

1) a time value for a run profile defining running of a guided vehicle between a platform and the boundary or a travel time from the platform to the boundary;

2) a setpoint value for a dwell time at the platform; and 3) a time of arrival at the boundary.

16. The method according to claim 11, which further comprises providing the set of the regulation data free of any data defining a position of an interlocking within the part of the first regulation domain.

17. The method according to claim 11, which further comprises installing at least one of a convergent junction point at the second position or a divergent junction point at the first position.

18. The method according to claim 11, wherein the second ATS system determines the regulation data based on the configuration data and the circulation data sent by the first ATS system.

19. The method according to claim 18, wherein the second ATS system determines the regulation data additionally based on at least one item selected from the group consisting of: a reference timetable of said second ATS system, a nominal timetable of said second ATS system, a current configuration data and circulation data of said second ATS system, and a traffic regulation criteria of said second ATS system.

* * * * *